US005316217A

United States Patent [19]

Guzowski et al.

[11] Patent Number: 5,316,217

[45] Date of Patent: May 31, 1994

[54] METHOD AND SYSTEM FOR DETECTING BLOCKAGE IN A SPRAY GUN OF A LIQUID SPRAY SYSTEM

[75] Inventors: Raymond J. Guzowski, Fenton; David W. Lazar, Troy, both of Mich.

[73] Assignee: FANUC Robotics North America, Inc., Auburn Hills, Mich.

[21] Appl. No.: 110,369

[22] Filed: Aug. 23, 1993

[51] Int. Cl.[5] ..... B67D 5/08

[52] U.S. Cl. ..... 239/71; 73/37; 137/557

[58] Field of Search ..... 239/71, 72, 74; 73/37, 73/38, 861, 52, 861.61; 137/551, 557

[56] References Cited

U.S. PATENT DOCUMENTS

| | | | |
|---|---|---|---|
| 2,127,501 | 8/1938 | Dall | 73/861.61 |
| 3,385,522 | 5/1968 | Kock . | |
| 3,482,781 | 12/1969 | Sharpe . | |
| 3,665,959 | 5/1972 | Castillon | 137/551 |
| 4,181,017 | 1/1980 | Markle | 73/168 |
| 4,368,852 | 1/1983 | Sharp et al. | 239/706 |
| 4,436,886 | 2/1984 | Rood | 239/71 |
| 4,662,798 | 5/1987 | Fassbinder | 73/861.61 |
| 4,668,948 | 5/1987 | Merkel | 239/71 |
| 4,712,736 | 12/1987 | Bray et al. | 239/72 |
| 5,096,120 | 3/1992 | Luckarz | 239/75 |

*Primary Examiner*—Andres Kashnikow
*Assistant Examiner*—Christopher G. Trainor
*Attorney, Agent, or Firm*—Brooks & Kushman

[57] ABSTRACT

A method and system are provided for detecting blockage in a spray gun of a liquid spray system wherein a first transducer is positioned to detect the pressure of paint or sealer in a supply line at an upstream position and a second transducer is positioned immediately adjacent and upstream a spray orifice of a spray gun to detect a second pressure of the liquid wherein a pressure drop of the liquid is calculated and a blockage signal is generated when the pressure drop is less than a predetermined amount. Preferably, the line and the spray gun are sized so that pressure drop is at least 10 psi and preferably approximately 350 psi in the absence of any blockage.

9 Claims, 1 Drawing Sheet

METHOD AND SYSTEM FOR DETECTING BLOCKAGE IN A SPRAY GUN OF A LIQUID SPRAY SYSTEM

TECHNICAL FIELD

This invention relates generally to methods and systems for detecting blockage in a spray gun of a liquid spray system and, in particular, to methods and systems for detecting blockage of a spray gun of a liquid spray system wherein multiple transducers are employed in order to detect a pressure drop in the system.

BACKGROUND ART

In spraying articles with liquid such as paint or sealant, it is important to completely cover the article. In automatic systems, if there is a malfunction in the paint spray system, the articles may be insufficiently coated. If the malfunction is not detected, the articles may have to be manually painted or must be passed through the system a second time. This obviously results in inefficient use of relatively expensive equipment, and potentially expensive manual rework.

A typical malfunction of such a liquid spray system is that the nozzle or spray tip of a spray gun of the system becomes plugged or clogged. This clogging or plugging may be either partial or total.

Tip blockage detection has been accomplished by using a single pressure transducer or sensor as illustrated at 10 in FIG. 1. This system works on the principle that if the pressure increases at the nozzle 12 of a spray gun 14, the spray gun tip is blocked. The transducer 10 may be placed anywhere in the system close to the gun 14 remote from a source 15 of pressurized liquid. Pressure limits are set in the software contained within a controller 16 of the system to flag a high pressure condition. In addition to the pressure transducer 10, a flow meter 18 may optionally be located in a liquid supply line 20 of the system.

One problem with the single transducer approach is that such a system is very sensitive to material viscosity changes and incoming material pressure changes. This is because the system works on the principle that a change in pressure indicates a plugged spray orifice. Pressure changes due to changes of the material causes enough of a change in pressure to indicate a plugged tip or a low pressure condition, which may or may not be true.

U.S. Pat. No. 4,430,886 to Rood discloses a method and apparatus for sensing a clogged nozzle in a spray gun by placing a restricter in the liquid flow path upstream of a valve and a pressure transducer between the restricter and the valve for measuring the pressure drop when the valve is open.

U.S. Pat. No. 3,482,781 to Sharpe discloses a spray gun including a pressure gauge that directly reads the pressure of air applied to the nozzle.

U.S. Pat. No. 4,368,852 to Sharpe et al discloses a combination spray gun and pressure regulator for providing even pressure of the liquid supply to the gun.

U.S. Pat. Nos. 3,385,522, 4,181,017 and 5,096,120 to Kock, Markle and Luckarz, respectively, all disclose pressure regulated spray systems. The '120 patent discloses the use of one sensor associated with a recirculating line and a second sensor associated with a tapping line.

SUMMARY OF THE INVENTION

An object of the present invention is to provide a method and system for detecting blockage in a spray gun of a liquid spray system which is relatively insensitive to material viscosity changes and incoming material pressure changes.

In carrying out the above object and other objects of the present invention, a method is provided for detecting blockage in a spray gun of a liquid spray system including a pressurized liquid supply, a spray gun having a spray orifice and a line for conveying pressurized liquid from the liquid supply to the spray gun. The liquid has a first pressure at an upstream position in the line and a second pressure less than the first pressure at a downstream position in the spray gun. The method includes the steps of generating a first signal based on the first pressure of the liquid, generating a second signal based on the second pressure of the liquid, and calculating a pressure drop of the liquid between the upstream and downstream positions based on the first and second signals. The method further includes the step of generating a blockage signal when the pressure drop of the liquid is less than a predetermined amount.

Preferably, the downstream position is located immediately adjacent and upstream the spray orifice of the spray gun. Also preferably, the line and the spray gun are sized so that the first pressure is at least 10 psi greater than the second pressure and is approximately 350 psi greater than the second pressure in the absence of any blockage of the spray gun.

Further in carrying out the above objects and other objects of the present invention, a system is provided for carrying out each of the above method steps.

The advantages accruing to the method and system of the present invention are numerous. For example, the method and system are relatively insensitive to liquid viscosity changes and incoming material pressure changes. The incoming pressure can increase and decrease and not effect the sensitivity of the system. The method and system can also be utilized in liquid spray systems where multiple spray guns are being supplied from a common pressurized liquid source where incoming pressure changes are common.

The above objects and other objects, features, and advantages of the present invention are readily apparent from the following detailed description of the best mode for carrying out the invention when taken in connection with the accompanying drawings.

BEST MODE FOR CARRYING OUT THE INVENTION

Figure 1:
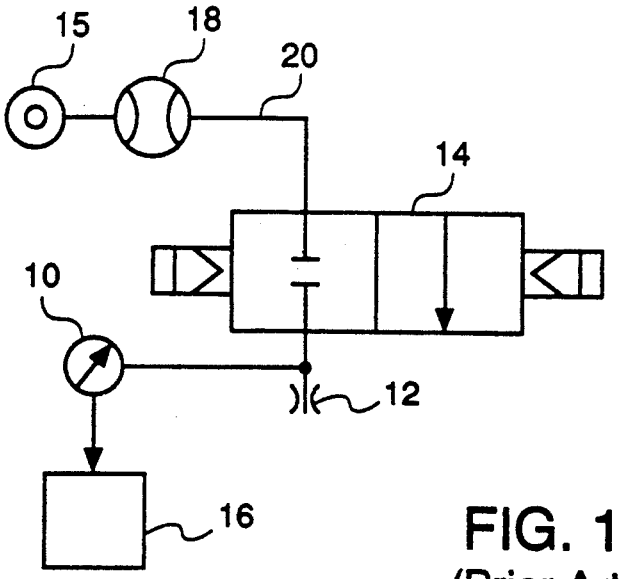
FIG. 1 (Prior Art)
FIG. 1 is a schematic diagram illustrating a prior art method and system for detecting plugged tips of liquid spray guns.
Figure 2:
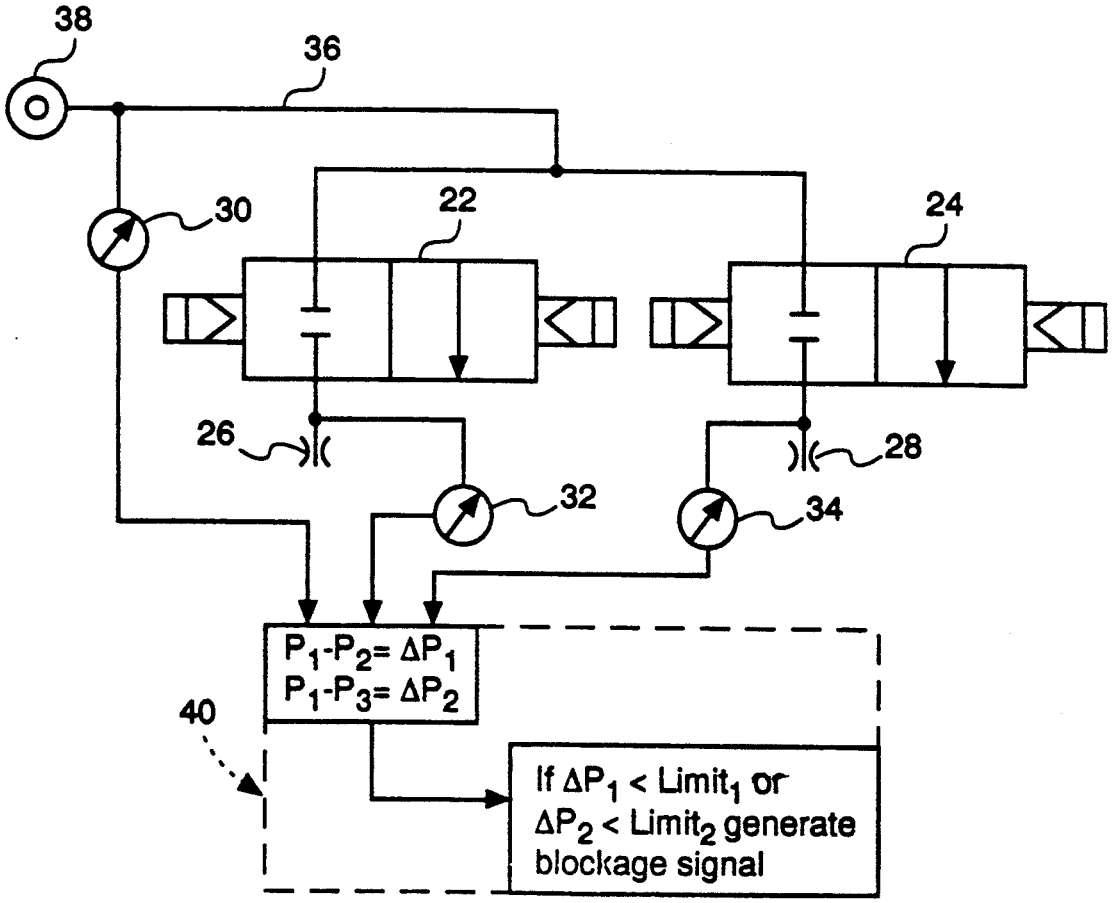
FIG. 2 is a schematic view partially in block diagram form illustrating the method and system of the present invention for detecting blockage in a spray gun of a liquid spray system, using dual spray guns.

Referring now to the drawing figures, there is illustrated the method and system of the present invention in FIG. 2. In general, the purpose of the method and system is to monitor the status of one or more spray guns 22 and 24 to determine if the spray orifices of spray gun nozzles 26 and 28, respectively, are plugged or clogged.

The method and system utilize three pressure transducers or sensors 30, 32 and 34. The transducers 32 and 34 are located directly upstream of their respective spray nozzles 26 and 28. The transducer 30 is located further upstream of the spray guns 22 and 24 in a supply line 36 of the system adjacent a pressurized liquid supply 38. While the method and system is illustrated in FIG. 2 in a two gun system, the method and system can also be utilized in a single gun system or a system having three or more guns.

Preferably, each of the pressure transducers 32 and 34 is located as near to the spray orifice of its spray gun 22 and 24 as possible. The supply line 26 and the internal liquid conveying passages of the spray guns 22 and 24 are sized to create a pressure drop greater than 10 psi and preferably approximately 350 psi in the absence of any blockage or pluggage in the spray guns 22 and 24. The higher the pressure differential across the transducers, the less chance of false alarms. With higher viscosity products such as plastisols, $\Delta P$ of approximately 350 psi is acceptable.

The following example illustrates the method and system of the present invention. In a dynamic state when spraying with the nozzle 26 which is not plugged, the difference between the pressures sensed by the transducers 30 and 32 will be approximately 350 psi. When the nozzle 26 starts to partially plug, the difference between the two transducers 30 and 32 becomes less. When fully plugged, the difference between the two transducers 30 and 32 will be approximately zero.

The transducers 30, 32 and 34 generate pressure signals $P_1$, $P_2$ and $P_3$, respectively, which are received by a computerized controller generally indicated at 40 of the system. The controller 40 calculates a pressure drop between upstream and downstream positions, (i.e. the locations of the transducers 30, 32 and 34) based on the difference between the signals as follows:

$P_1 - P_2$ = Pressure Drop, $\Delta P_1$, for gun 22; and $P_1 - P_3$ = Pressure Drop, $\Delta P_2$, for gun 24.

If the pressure drop $\Delta P_1$ is less than a first limit, $Limit_1$, or if the pressure drop $\Delta P_2$ is less than a second limit, $Limit_2$, then a blockage signal is generated. The signal can be used to alert maintenance personnel to unblock the gun 22 or 24.

The method and system are particularly advantageous in dispensing liquid spray or in a dispensing system where multiple spray guns are being supplied from a common pressurized liquid source where incoming pressure changes are common as illustrated in FIG. 2.

While the best mode for carrying out the invention has been described in detail, those familiar with the art to which this invention relates will recognize various alternative designs and embodiments for practicing the invention as defined by the following claims.

What is claimed is:

1. A method for detecting blockage in a spray gun of a liquid spray system including a pressurized liquid supply, a spray gun having a spray orifice and a line for conveying pressurized liquid from the liquid supply to the spray gun, the liquid having a first pressure at an upstream position in the line and a second pressure less than the first pressure at a downstream position in the spray gun, the method comprising the steps of:

generating a first signal based on the first pressure of the liquid;

generating a second signal based on the second pressure of the liquid;

calculating a pressure drop of the liquid between the upstream and downstream positions based on the first and second signals; and generating a blockage signal when the pressure drop of the liquid is less than a predetermined amount.

2. The method as claimed in claim 1 wherein the downstream position is located immediately adjacent and upstream of the spray orifice of the spray gun.

3. The method as claimed in claim 1 wherein the line and the spray gun are sized so that the first pressure is at least 10 psi greater than the second pressure in the absence of blockage in the spray gun.

4. The method as claimed in claim 3 wherein the first pressure is substantially greater than the second pressure in the absence of blockage in the spray gun.

5. A system for detecting blockage in a spray gun of a liquid spray system including a pressurized liquid supply, a spray gun having a spray orifice and a line for conveying pressurized liquid from the liquid supply to the spray gun, the liquid having a first pressure at an upstream position in the line and a second pressure less than the first pressure at a downstream position in the spray gun, the system comprising:

a first sensor for sensing the first pressure of the liquid and generating a first signal based on the first pressure;

a second sensor for sensing the second pressure and generating a second signal based on the second pressure; and control means coupled to the first and second sensors for receiving the first and second signals, calculating a pressure drop of the liquid between the upstream and downstream positions based on the first and second signals and for generating a blockage signal when the pressure drop of the liquid is less than a predetermined amount.

6. The system as claimed in claim 5 wherein the downstream position is located immediately adjacent and upstream of the spray orifice of the spray gun.

7. The system as claimed in claim 5 wherein the line and the spray gun are sized so that the first pressure is at least 10 psi greater than the second pressure in the absence of blockage in the spray gun.

8. The system as claimed in claim 7 wherein the first pressure is approximately 350 psi greater than the second pressure in the absence of blockage in the spray gun.

9. A system for detecting blockage in spray guns of a liquid spray system including a single pressurized liquid supply, first and second sprays guns, each of those spray guns having a spray orifice, and a line for conveying pressurized liquid from the liquid supply to each of the spray guns, the liquid having a first pressure at an upstream position in the line, a second pressure less than the first pressure at a first downstream position in the first spray gun, and a third pressure less than the first pressure at a second downstream position in the second spray gun, the system comprising:

a first sensor for sensing the first pressure of the liquid and generating a first signal based on the first pressure;

a second sensor for sensing the second pressure of the liquid and generating a second signal based on the second pressure;

a third sensor for sensing the third pressure and generating a third signal based on the third pressure; and control means coupled to the first, second and third sensors for receiving the first, second and third signals and for calculating a first pressure drop of the liquid between the upstream and first downstream positions based on the first and second signals, for calculating a second pressure drop of the liquid between the upstream and second downstream positions based on the first and third signals and for generating a blockage signal when either of the first and second pressure drops of the liquid is less than a predetermined amount.

* * * * *